US011892216B2

(12) United States Patent
Chen et al.

(10) Patent No.: US 11,892,216 B2
(45) Date of Patent: Feb. 6, 2024

(54) REFRIGERATION SYSTEM WITH DIRECT EXPANSION REFRIGERATION MODE AND REFRIGERANT PUMPING ENERGY-EFFICIENCY MODE AND CONTROL METHOD OF REFRIGERATION SYSTEM

(71) Applicant: AIRSYS Refrigeration Engineering Technology (Beijing) Co. Ltd., Beijing (CN)

(72) Inventors: Yunshui Chen, Beijing (CN); Fengpo Chen, Beijing (CN); Xuming Fang, Beijing (CN); Hongqiu Yin, Beijing (CN)

(73) Assignee: AIRSYS Refrigeration Engineering Technology (Beijing) Co. Ltd., Beijing (CN)

( * ) Notice: Subject to any disclaimer, the term of this patent is extended or adjusted under 35 U.S.C. 154(b) by 0 days.

(21) Appl. No.: 17/828,058

(22) Filed: May 31, 2022

(65) Prior Publication Data

US 2023/0152017 A1 May 18, 2023

(30) Foreign Application Priority Data

Nov. 18, 2021 (CN) ..... 202111370440.2

(51) Int. Cl.

| | |
|---|---|
| ***F25B 49/02*** | (2006.01) |
| ***F25B 25/00*** | (2006.01) |
| *F25B 41/40* | (2021.01) |

(52) U.S. Cl.

CPC ..... *F25B 49/022* (2013.01); *F25B 25/005* (2013.01); *F25B 41/40* (2021.01); *F25B 2400/0401* (2013.01); *F25B 2500/26* (2013.01); *F25B 2600/111* (2013.01); *F25B 2600/13* (2013.01); *F25B 2700/193* (2013.01); (Continued)

(58) Field of Classification Search

CPC .. F25B 25/005; F25B 49/022; F25B 2500/26; F25B 2600/111; F25B 2600/13; F25B 2700/193; F25B 2700/2104; F25B 2700/2106; F25B 2700/2117

See application file for complete search history.

(56) References Cited

U.S. PATENT DOCUMENTS

| | | | | |
|---|---|---|---|---|
| 2010/0042265 | A1* | 2/2010 | Rigal | F25B 25/00 700/300 |
| 2013/0098085 | A1* | 4/2013 | Judge | F25B 41/00 62/190 |

* cited by examiner

*Primary Examiner* — Jonathan Bradford
(74) *Attorney, Agent, or Firm* — Yu Gang

(57) ABSTRACT

A refrigeration system and a control method of the refrigeration system are provided. The refrigeration system includes a cooling circuit and a compressor, an evaporator assembly, and a condenser assembly sequentially arranged on the cooling circuit, and the refrigeration system further includes: a liquid pump cooling assembly, arranged on the cooling circuit and located between the condenser assembly and the evaporator assembly, the liquid pump cooling assembly includes a housing and a liquid pump arranged in the housing, the housing defines a cavity having a liquid reserving function, a refrigerant inlet, a first outlet connected to the cavity and a second outlet connected to the liquid pump, an outlet of the condenser assembly is in connected with the refrigerant inlet, and both the first and second outlets are connected with an inlet of the evaporator assembly; a control assembly, connected with the compressor and the liquid pump.

19 Claims, 4 Drawing Sheets

(52) U.S. Cl.
CPC ..... *F25B 2700/2104* (2013.01); *F25B 2700/2106* (2013.01); *F25B 2700/2117* (2013.01)

REFRIGERATION SYSTEM WITH DIRECT EXPANSION REFRIGERATION MODE AND REFRIGERANT PUMPING ENERGY-EFFICIENCY MODE AND CONTROL METHOD OF REFRIGERATION SYSTEM

CROSS-REFERENCE TO RELATED APPLICATION(S)

The present disclosure claims priority to patent application No. 202111370440.2, presented and filed in the China National Intellectual Property Administration on Nov. 18, 2021, entitled "Refrigeration System and Control Method of Refrigeration System".

TECHNICAL FIELD

The disclosure relates to the field of air conditioning refrigeration, and particularly, to a refrigeration system and a control method of the refrigeration system.

BACKGROUND

At present, in the field of air conditioning refrigeration, a compressor refrigeration cycle and a fluorine pump refrigeration cycle are two refrigeration systems that are usually employed, the amounts of refrigerants used for the two refrigeration cycles are different, therefore to balance the amounts of refrigerants used for the two, a reservoir for temporarily reserving excess refrigerants in a cycle circuit is usually added between a fluorine pump and an outdoor unit. However, in this way, the amount of refrigerants used in the systems will be increased and the cost of the systems will also be increased, and when the system leaks, there would be a significant impact on the environment; furthermore, due to the need to store a large amount of excess refrigerants, the reservoir needs to able to hold a large volume of refrigerant, resulting in an increase in the volume of the entire refrigeration system.

SUMMARY

Some embodiments of the present disclosure provide a refrigeration system and the control method of the refrigeration system. Reduce the volume of the refrigeration system and the energy consumption.

To achieve the above-mentioned objective, according to the given examples of the present disclosure, a refrigeration system is provided. The refrigeration system includes a cooling circuit and a compressor, an evaporator assembly, and a condenser assembly sequentially arranged on the cooling circuit, and the refrigeration system further includes: a liquid pump cooling assembly, arranged on the cooling circuit and located between the condenser assembly and the evaporator assembly, the liquid pump cooling assembly includes a housing and a liquid pump arranged in the housing, the housing defines a cavity having a liquid reservation function, a refrigerant inlet connected with the cavity, a first outlet connects with the cavity and a second outlet connects with the liquid pump, an outlet of the condenser assembly connects with the refrigerant inlet, and both the first and second outlets are connected with an inlet of the evaporator assembly; a control assembly, the compressor and the liquid pump are connected with the control assembly respectively, enabling the refrigeration system to have a direct expansion refrigeration mode and a refrigerant pump energy-efficiency mode; in the direct expansion refrigeration mode, the compressor is in an open state and compresses the refrigerant that is in a vapor phase, and the liquid pump is in a closed state, the refrigerant flowing out from the outlet of the condenser assembly enters into the evaporator assembly after sequentially passing through the refrigerant inlet and the first outlet so as to enable the refrigerant to circulate in the cooling circuit through the compressor; in the refrigerant pump energy-efficiency mode, the liquid pump is in an open state and pumps the refrigerant in a liquid state, and the compressor is in a closed state, under the action of the liquid pump, the refrigerant flowing out from the outlet of the condenser assembly flows out of the second outlet and enters into the evaporator assembly.

The refrigeration system further includes: a first pipeline, an end of the first pipeline being connected with the second outlet, an other end of the first pipeline is in a connection with the inlet of the evaporator assembly; a first one-way valve, arranged on the cooling circuit, and located between the refrigerant inlet, and a connecting node of the first pipeline and the cooling circuit, the first one-way valve is configured to prevent the refrigerant from flowing back to the refrigerant inlet, when the refrigeration system is in the refrigerant pump energy-efficiency mode, the refrigerant flowing out from the outlet of the condenser assembly flows into the evaporator assembly through the first pipeline.

In reference to the vertical direction, a height dimension of the first outlet is smaller than the height dimension of the second outlet, and the refrigerant inlet is located between the first and second outlets, the liquid pump is located below the cavity, and an interior chamber of the liquid pump is connected with the cavity.

The refrigeration system further includes: a second pipeline, arranged in parallel with the compressor, a first end of the second pipeline being connected with an outlet of the evaporator assembly, a second end of the second pipeline is connected with an inlet of the condenser assembly; and a second one-way valve, located on the second pipeline.

The refrigeration system further includes a solenoid valve located on the cooling circuit, wherein the solenoid valve is located between an inlet of the compressor and a connecting node of the second pipeline and the cooling circuit.

The condenser assembly includes: a condenser body having a condensing inlet and a condensing outlet; a gas header, connected with the condensing inlet, and the gas header being connected with an outlet of the compressor; a liquid header, connected with the condensing outlet, and the liquid header being connected with the refrigerant inlet; a pipe diameter of the liquid header is greater than a pipe diameter of the gas header.

The condenser body is of V-shaped, and the condenser assembly further includes a condensing fan located over the condenser body, and the condenser assembly includes a first branch pipe and a second branch pipe, the gas header is connected with the outlet of the condenser through the first branch pipe, and the liquid header is connected with the refrigerant inlet through the second branch pipe.

The refrigeration system further includes: an expansion valve, arranged between the evaporator assembly and the liquid pump cooling assembly; a first temperature sensor, along with a flow direction of the refrigerant in the cooling circuit, located at an upstream position of the expansion valve to detect a temperature of the refrigerant entering the evaporator assembly.

According to some embodiments of the present disclosure, a control method for controlling by adopting the above-mentioned refrigeration system is provided. The control method includes: an energy-efficiency refrigeration step of controlling the refrigeration system to be in a refrigerant pumping energy-efficiency mode; a compression refrigeration step of controlling the refrigeration system to be in a direct expansion refrigeration mode.

The condenser assembly includes a condenser body and a condensing fan located at a side of the condenser body. After the energy-efficiency refrigeration step, the control method further includes: determining a pressure level of the second outlet and a pressure level the refrigerant inlet; and a pressure level evaluation step of evaluating whether or not the pressure level of the second outlet of a liquid pump cooling assembly is greater than the pressure level of the refrigerant inlet, if so, the step of adjusting a rotation speed of a condensing fan or of a liquid pump is executed; if not, an abnormality processing step is executed.

After the energy-efficiency refrigeration step, the control method further includes: a detection step of detecting a temperature of the refrigerant that enters into the evaporator assembly; a temperature judgment step of judging whether or not the temperature of the refrigerant is below zero, if so, the step of adjusting a rotation speed of the condensing fan of the condenser assembly is executed; if not, the temperature judgment step is repeatedly executed.

In some embodiments, in the compression refrigeration step, the control method further includes an adjustment step of adjusting a rotation speed of a compressor.

The technical solution of the present disclosure is applied, the evaporator assembly is configured to evaporate the liquid refrigerant that flows into a gaseous refrigerant, and a low-temperature and low-pressure refrigerant gas flows out; the condenser assembly may function to dissipate heat and to condense the gaseous refrigerant into a liquid refrigerant; the compressor is configured to compress the low-pressure refrigerant gas that flows into a superheated high-pressure refrigerant gas, and the compressor can drive the refrigerant to circulate in the cooling circuit. The liquid pump cooling assembly includes the housing and the liquid pump arranged in the housing. In this way, the housing defines a cavity having a liquid reservoir function, so that the cavity and liquid pump are connected and form a complete structure, so there is no need to additionally arrange a separate reservoir. After this arrangement, the liquid pump cooling assembly is small in volume and compact in structure, and the arrangement may further reduce the refrigerant charge in the refrigeration system, so as to achieve functions of reducing energy consumption and costs; and at the same time, since the above-mentioned liquid pump cooling assembly is provided therein with one inlet and two outlets (i.e. the first outlet and the second outlet), the two outlets may send the refrigerant to different pipelines, and the refrigeration system can have the direct expansion refrigeration mode and the refrigerant pumping energy-efficiency mode, so as to achieve a function of integrating two refrigeration modes on the same cooling circuit; in addition, switching between the above-mentioned two refrigeration modes may be further achieved based on demand by the control assembly that connects to the compressor and the liquid pump.

BRIEF DESCRIPTION OF THE DRAWINGS

The accompanying drawings, which form a part of the present application, are used to provide a further understanding of the present disclosure, and the illustrative examples of the present disclosure and the description thereof are used for explaining the present disclosure, and do not constitute an improper limitation to the present disclosure. In the drawings.

The above-mentioned drawings include the following reference signs:

1. Compressor; 2. Solenoid valve; 3. Second one-way valve; 4. Third one-way valve; 5. Second temperature sensor; 6. Condenser assembly; 7. Condensing fan; 8. First pressure sensor; 9. Liquid pump cooling assembly; 10. First one-way valve; 11. Second pressure sensor; 12. First temperature sensor; 13. Expansion valve; 14. Evaporator assembly; 15. Indoor fan; 16. Third Temperature sensor; 17. Condenser body; 18. Gas header; 19. Liquid header; 20. First branch pipe; 21. Second branch pipe; 22. Control assembly; 90. Housing; 91. First outlet; 92. Second outlet; 93. Refrigerant inlet; 94. Cavity; 95. Liquid pump; 96. Inner inlet; 97. Inner outlet; 98. Outlet pipe; 99. Impeller; 100. Cooling circuit; 200. First pipeline; 300. Second pipeline.

DETAILED DESCRIPTION OF THE EMBODIMENTS

It is to be noted that the examples in the present application and the features in the examples may be combined with each other if there is no conflict. The present disclosure will be described in detail below with reference to the accompanying drawings and in combination with the examples.

Figure 1:
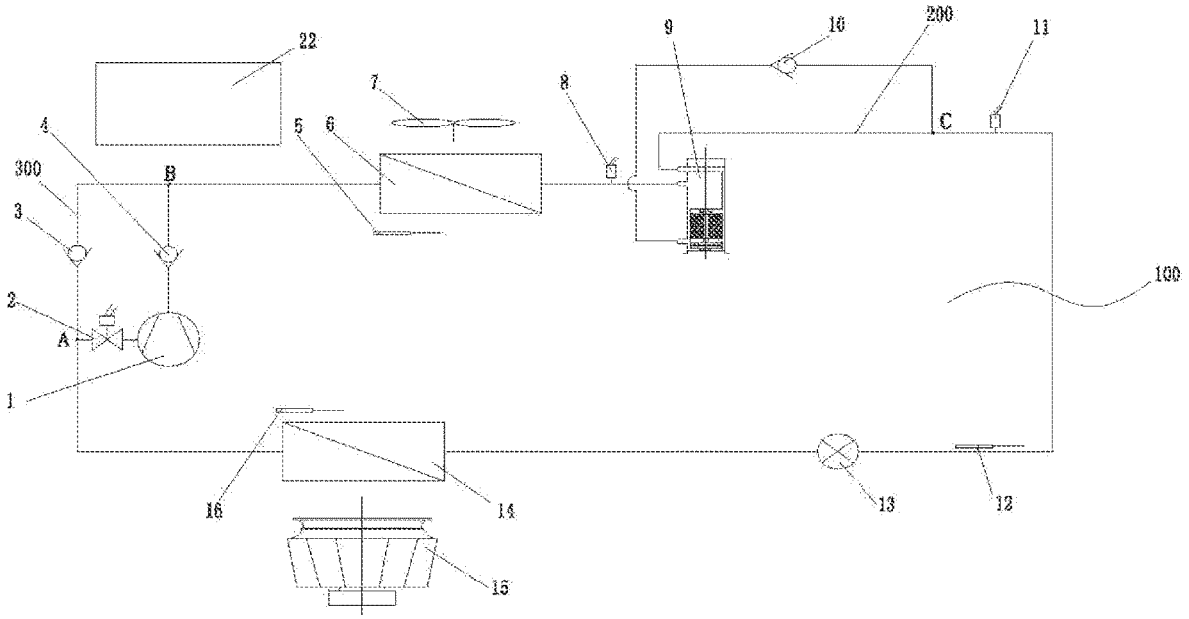
FIG. 1 shows a schematic of the principle diagram showing the refrigeration system according to the present disclosure

As shown in FIG. 1, some examples of the present disclosure present a refrigeration system. The refrigeration system includes a cooling circuit 100 and a compressor 1, an evaporator assembly 14, and a condenser assembly 6 sequentially arranged on the cooling circuit 100. The compressor 1, the evaporator assembly 14, and the condenser assembly 6 each have an inlet and an outlet, and the refrigeration system further includes a liquid pump cooling assembly 9, a control assembly 22, and an indoor fan 15. Wherein, the liquid pump cooling assembly 9 is arranged on the cooling circuit 100 and located between the condenser assembly 6 and the evaporator assembly 14, and the liquid pump cooling assembly 9 includes a housing 90 and a liquid pump 95 arranged in the housing 90, the housing 90 defines a cavity 94 having a liquid reserving function, a refrigerant inlet 93 communicating with the cavity 94, a first outlet 91 communicating with the cavity 94 and a second outlet 92 communicating with the liquid pump 95, an outlet of the condenser assembly 6 is in communication with the refrigerant inlet 93, and both the first and second outlets 91, 92 are in communication with an inlet of the evaporator assembly 14; a control assembly 22 is connected with the compressor 1 and the liquid pump 95, so as to enable the refrigeration system to have a direct expansion refrigeration mode and a refrigerant pumping energy-efficiency mode; in the direct expansion refrigeration mode, the compressor 1 is in an open state and compresses refrigerant that is in a vapor phase, and the liquid pump 95 is in a closed state, refrigerant flowing out from the outlet of the condenser assembly 6 enters into the evaporator assembly 14 after sequentially passing through the refrigerant inlet 93 and the first outlet 91, so as to enable the refrigerant to circulate in the cooling circuit 100 by the compressor 1; in the refrigerant pumping energy-efficiency mode, the liquid pump 95 is in an open state and pumps liquid refrigerant, and the compressor 1 is in a closed state, under an action of the liquid pump 95, refrigerant flowing out from the outlet of the condenser assembly 6 flows out from the second outlet 92 and enters into the evaporator assembly 14.

In the above-mentioned technical solution, in the refrigeration system, the evaporator assembly 14 is configured to evaporate liquid refrigerant that flows in into a gaseous refrigerant, and a low-temperature and low-pressure refrigerant gas flows out; the condenser assembly 6 may function to dissipate heat and to condense the gaseous refrigerant into a liquid refrigerant. When the refrigeration system is in the direct expansion refrigeration mode, the control assembly 22 controls the compressor 1 to be in an open state and the liquid pump 95 to be in a closed state, the compressor 1 is configured to compress the low-pressure refrigerant gas that flows in into a superheated high-pressure refrigerant gas, and the compressor 1 is able to drive the refrigerant to circulate in the cooling circuit 100; the outlet of the compressor 1 is connected with the inlet of the condenser assembly 6, so as to send the gaseous refrigerant compressed by the compressor 1 to the condenser assembly 6.

The above-mentioned gaseous refrigerant dissipates heat in the condenser assembly 6 and is condensed into a high-pressure saturated liquid refrigerant and then flows out. The above-mentioned liquid refrigerant flows into the cavity from the refrigerant inlet 93 and directly flows out from the first inlet 91, and then enters the evaporator assembly 14, to achieve circulation of the refrigerant in the cooling circuit 100.

When the refrigeration system is in the refrigerant pumping energy-efficiency mode, the control assembly 22 controls the compressor 1 to be in a closed state and the liquid pump 95 to be in an open state, a low-temperature and low-pressure liquid refrigerant can flow out from the condenser assembly 6, the outlet of the condenser assembly 6 connects with the refrigerant inlet 93 of the liquid pump cooling assembly 9. Under the pumping action of the liquid pump 95, the liquid refrigerant is pumped into the evaporator assembly 14 through the second outlet 92. In this mode, the liquid refrigerant achieves circulating in the cooling circuit by bypassing the compressor 1. Therefore, the above-mentioned refrigeration system has the direct expansion refrigeration mode and the refrigerant pumping energy-efficiency mode.

In this way, when outdoor temperature is high, the refrigeration system cannot use the outdoor temperature to cool down indoor equipment and so opens the direct expansion refrigeration mode, at this moment the compressor 1 is in an open state and the liquid pump 95 is in a closed state; when the outdoor temperature is low and can meet natural cooling demand, the compressor 1 is in the closed state, and the liquid pump 95 is in the open state, the refrigerant may make full use of outdoor natural resources to cool down the indoor equipment without passing through the compressor 1, so as to achieve functions of reducing energy consumption and costs.

In some examples of the present disclosure, the liquid pump cooling assembly 9 includes a housing 90 and a liquid pump 95 arranged in the housing 90. In this way, the housing 90 defines a cavity 94 having a liquid reserving function, so that the cavity 94 and liquid pump 95 are used as one modular structure without additionally arranging a separate reservoir. After this arrangement, the liquid pump cooling assembly 9 is small in volume and compact in structure, and the arrangement may further reduce the refrigerant charge in the refrigeration system, so as to achieve functions of reducing energy consumption and costs; and at the same time, since the above-mentioned liquid pump cooling assembly 9 is provided therein with one inlet and two outlets (i.e. the first outlet 91 and the second outlet 92), the two outlets may send the refrigerant to different pipelines, and the refrigeration system is able to have the direct expansion refrigeration mode and the refrigerant pumping energy-efficiency mode, so as to achieve a function of integrating the two refrigeration modes on the same cooling circuit 100; in addition, by means of the control assembly 22 that connects with the compressor 1 and the liquid pump 95, switching between the above-mentioned two refrigeration modes may further achieved based on demand.

In some embodiments, the liquid pump 95 is a vertical-type centrifugal pump.

In others, the liquid pump 95 is a fluorine pump.

Figure 2:
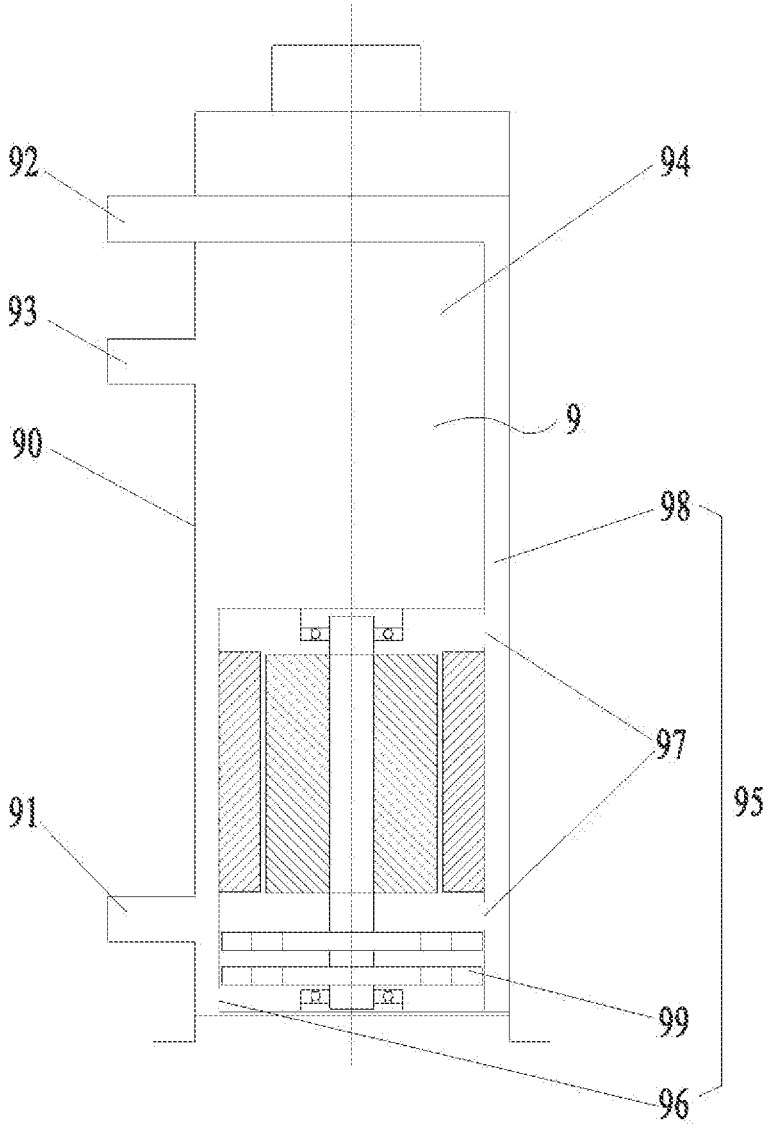
FIG. 2 shows a schematic structural diagram of a liquid pump cooling assembly of FIG. 1 according to the example of the present disclosure

As shown in FIG. 2, in the present disclosure, in a vertical direction, a height dimension of the first outlet 91 is smaller than a height dimension of the second outlet 92, and the refrigerant inlet 93 is located between the first and second outlets 91, 92, the liquid pump 95 is located below the cavity 94, and an interior chamber of the liquid pump 95 is connected with the cavity 94.

Since the liquid pump cooling assembly 9 has the first outlet 91 and the second outlet 92, so that a flow path of refrigerant in the refrigeration system in different modes is determined. The liquid pump 95 includes a pump shell, and an impeller 99 and an electric motor in the pump shell, the pump shell defines an interior chamber of the liquid pump 95, and the pump shell is further provided with an inner inlet 96 communicating with the cavity 94 and an inner outlet 97 communicating to the second outlet 92, both the inner inlet 96 and the inner outlet 97 are in communication with the interior chamber of the liquid pump 95.

With the above-described arrangement, in the refrigerant pumping energy-efficiency mode, the liquid pump 95 can pump the refrigerant flowing into the liquid pump cooling assembly 9 to the cooling circuit 100.

In the above-mentioned technical solution, the liquid pump 95 is arranged below the cavity 94, such an arrangement reserves sufficient liquid reserving space; in the vertical direction of the liquid pump cooling assembly 9, the second outlet 92, the refrigerant inlet 93 and the first outlet 91 are sequentially arranged from top to bottom, in this way, after flowing from the refrigerant inlet 93, the refrigerant can move downward under the influence of gravity and fills the interior chamber of the liquid pump 95; in the refrigerant pumping energy-efficiency mode, the liquid refrigerant located in the interior chamber of the liquid pump 95 is pumped by the liquid pump 95 to flow out of the inner inlet 97 to the second outlet 92 and flows into the cooling circuit 100; in the direct expansion refrigeration mode, the liquid pump 95 is in the closed state, the refrigerant flowing into the liquid pump cooling assembly 9 passes through the cavity 94 and directly flows out from the first outlet 91 at a bottom of the liquid pump cooling assembly 9.

Since the usage amounts of the coolant needed in the direct expansion refrigeration mode and the refrigerant pumping energy-efficiency mode are different, the cavity 94 is employed to adjust the usage amounts of the coolant in two modes. Specifically, the liquid pump cooling assembly 9 is the cavity 94 having a liquid reserving function and the liquid pump 95 from top to bottom, respectively. The liquid pump 95 includes the electric motor and the impeller 99. The liquid pump 95 is provided with the inner inlet 96 and the two inner outlets 97 for the impeller 99 to drive the refrigerant to be discharged, the two inner outlets 97 connect with the second outlet 92 through an outlet pipe 98. After the refrigerant enters the liquid pump cooling assembly 9 from the refrigerant inlet 93, it will fill a lower portion due to gravity, a lower part of the housing 90 is provided with the first outlet 91, and the liquid pump 95 is provided with the inner inlet 96 through which the refrigerant enters the cavity of the impeller 99 of the liquid pump 95. Therefore, the cavity 94 may adjust the usage amounts of the coolant in two operation modes, meanwhile when the refrigerant pumping energy-efficiency mode operates, the coolant liquid fills up the cavity 94 allowing the impeller 99 of the liquid pump 95 to be always filled up with liquid, in this way, the operation reliability and stability of the liquid pump 95 is ensured, since once the gaseous refrigerant occurs in the cavity of the impeller 99, the liquid pump 95 will lose its effect, and the liquid pump 95 operating in a no-load operation will increase the temperature of the electric motor, and its prolonged operation will cause an electric motor failure; if cavitation occurs, the impeller 99 of the liquid pump 95 will be damaged too early.

As shown in FIG. 1 and FIG. 2, in some examples of the present disclosure, the refrigeration system further includes a first pipeline 200 and a first one-way valve 10. A first end of the first pipeline 200 is in communication with the second outlet 92, and a second end of the first pipeline 200 is in communication with the inlet of the evaporator assembly 14; the first one-way valve 10 is arranged on the cooling circuit 100, and located between the refrigerant inlet 93 and a connecting node B of the first pipeline 200 and the cooling circuit 100, the first one-way valve 10 is configured to prevent the refrigerant from flowing back to the refrigerant inlet 93, when the refrigeration system is in the refrigerant pumping energy-efficiency mode, the refrigerant flowing out from the outlet of the condenser assembly 6 flows into the evaporator assembly 14 through the first pipeline 100.

With the above-mentioned arrangement, the first pipeline 200 may achieve the function of integrating the two refrigeration modes on the same circulation circuit; when the refrigeration system is in the refrigerant pumping energy-efficiency mode, the first one-way valve 10 prevents the refrigerant flowing out from the second outlet 92 of the liquid pump cooling assembly 9 from flowing back to the first outlet 91 by a pipeline where the first one-way valve 10 is located, so that the refrigerant is prevented from flowing to the liquid pump cooling assembly 9, which results in interruption of the whole refrigeration circulation, thereby ensuring the refrigerant in the cooling circuit 100 to flow orderly, and thus achieving the best cooling effect.

In the above-mentioned technical solution, by arranging the first pipeline 200, the refrigerant can directly flow into the evaporator assembly 14 through the first pipeline 200 from the outlet of the condenser assembly 6, and at this moment, the refrigeration system is in the direct expansion refrigeration mode; the first one-way valve 10 can only allow the refrigerant to flow toward the inlet of the evaporator assembly 14 from the first outlet 91 of the liquid pump cooling assembly 9, which prevents the refrigerant from flowing in a reverse direction.

As shown in FIG. 1, in some embodiments of the present disclosure, the refrigeration system further includes a second pipeline 300 and a second one-way valve 3. The second pipeline 300 is arranged in parallel with the compressor 1, the first end of the second pipeline 300 is connected to the outlet of the evaporator assembly 14, the second end of the second pipeline 300 is connected with the inlet of the condenser assembly 6; and the second one-way valve 3 is located on the second pipeline 300.

With the above-mentioned arrangement, by arranging the second pipeline 300, the refrigerant flowing out from the outlet of the evaporator assembly 14 may not pass through the compressor 1 but directly flow into the condenser assembly 6 through the second pipeline 300. In this way, the second pipeline 300 arranged in parallel with the compressor 1 is employed to ensure the refrigerant has different flow paths in the cooling circuit 100, so as to achieve that the refrigerant flows into the cooling circuit 100 after being compressed by the compressor 1 and the refrigerant bypasses the compressor 1 and flows into the cooling circuit 100 from the second pipeline 300, so that the refrigeration system has the direct expansion refrigeration mode and the refrigerant pumping energy-efficiency mode, and thus the function of integrating the two refrigeration modes on the same circulation circuit is achieved; in addition, when the refrigeration system is in the refrigerant pumping energy-efficiency mode, the second one-way valve 3 may prevent the refrigerant from flowing back to the evaporator assembly 14 from the condenser assembly 6, thereby ensuring the natural cooling and refrigeration to be performed effectively in the refrigerant pumping energy-efficiency mode.

As shown in FIG. 1, in some embodiments of the present disclosure, the refrigeration system further includes a solenoid valve 2 arranged on the cooling circuit 100 and located between a connecting node A of the second pipeline 300 and the cooling circuit 100, and the inlet of the compressor 1.

With the above-mentioned arrangement, controlling the opening and closing of the solenoid valve 2 may ensure the refrigerant to flow based on correct paths in different modes, to avoid affecting normal operation of refrigeration circulation, thereby achieving the best refrigeration effect; and at the same time, the refrigeration system may further achieve switching between two modes based on actual demand.

In the above-mentioned technical solution, when the refrigeration system is in the direct expansion refrigeration mode, the control assembly 22 controls the solenoid valve 2 to be in the open state, so as to ensure that the refrigerant flowing out from the outlet of the evaporator assembly 14 can be totally sucked into the compressor 1 and cannot flow into the second pipeline 300; when the refrigeration system is in the refrigerant pumping energy-efficiency mode, the control assembly 22 controls the solenoid valve 2 to be in the closed state, so as to ensure that the refrigerant flowing out from the outlet of the evaporator assembly 14 can totally and directly flow into the condenser assembly 16 through the second pipeline 300, and cannot be sucked into the compressor 1.

As shown in FIG. 1, in the present disclosure, the refrigeration system further includes a third one-way valve 4 arranged on the cooling circuit 100 and located between the connecting node B of the second pipeline 300 and the cooling circuit 100, and the outlet of the compressor 1.

With the above-mentioned arrangement, the third one-way valve 4 may prevent the refrigerant flowing back to the outlet of the compressor 1 through the second pipeline 300, to ensure the natural cooling and refrigeration to be performed effectively in the refrigerant pumping energy-efficiency mode.

Figure 3:
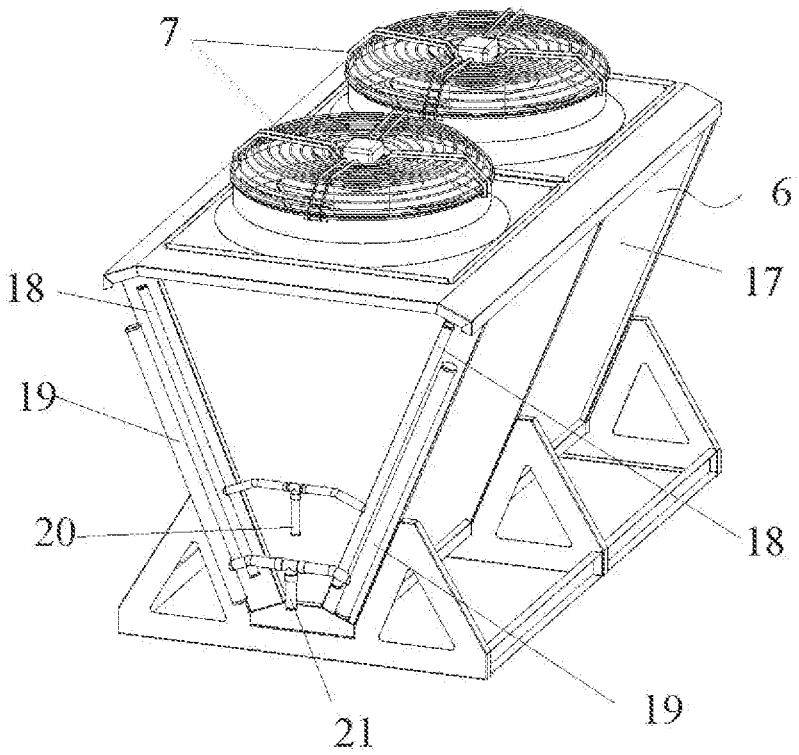
FIG. 3 shows a schematic structural diagram of a condenser assembly of FIG. 1 according to the example of the present disclosure.

As shown in FIG. 1 to FIG. 3, in some embodiments of the present disclosure, the condenser assembly 6 includes a condenser body 17, a gas header 18, and a liquid header 19. The condenser body 17 has a condensing inlet and a condensing outlet; the gas header 18 is in communication with the condensing inlet, and the gas header 18 is connected to the outlet of the compressor 1; the liquid header 19 is connected with the condensing outlet, and the liquid header 19 is connected with the refrigerant inlet 93; a pipe diameter of the liquid header 19 is greater than a pipe diameter of the gas header 18.

With the above-mentioned arrangement, since the pipe diameter of the liquid header 19 is large, thus the liquid header 19 has a certain liquid reserving function, in a case where both the liquid header 19 and the cavity 94 of the liquid pump cooling assembly 9 have the liquid reserving function, a coolant capacity of the refrigeration system may be added to effectively balance the amount of coolant in another operation mode; in addition, the refrigeration system may not need to additionally arrange a separate reservoir, which may reduce the refrigerant charge in the refrigeration system, so as to achieve functions of reducing energy consumption and costs.

In the above-mentioned technical solution, the refrigerant gas flowing out from the outlet of the compressor 1 flows into the condensing inlet through the cooling circuit 100 and enters into the gas header 18 from the condensing inlet, the gaseous refrigerant may be condensed into a refrigerant liquid in the condenser assembly 6, the condensed refrigerant liquid can be reserved in the liquid header 19 and be flowed out of the condenser assembly 6 from the condensing outlet. Since the liquid header 19 is connected to the refrigerant inlet 93, the refrigerant liquid flowed out can be sent to the liquid pump cooling assembly 9.

As shown in FIG. 1 to FIG. 3, in the present disclosure, the condenser body 17 is of V-shaped, and the condenser assembly 6 further includes a condensing fan 7 arranged over the condenser body 17, and the condenser assembly 6 includes a first branch pipe 20 and a second branch pipe 21, the gas header 18 is connected with the outlet of the compressor 1 by the first branch pipe 20, and the liquid header 19 is connected with the refrigerant inlet 93 by the second branch pipe 21.

In the above-mentioned technical solution, the condensing fan 7 may speed up heat transfer effect of the refrigerant in the condenser body 17; in addition, the gas header 18 of the condenser assembly 6 is connected with the outlet of the compressor 1 by the first branch pipe 20 and the second branch pipe 21, the liquid header 19 is connected with the refrigerant inlet 93, such an arrangement facilitates the flowing of the gas refrigerant that flows out of the compressor 1 to the condenser assembly 6, and the flowing of the liquid refrigerant condensed and formed by the condenser assembly 6 to the liquid pump cooling assembly 9.

As shown in FIG. 1, in some embodiments of the present disclosure, the refrigeration system further includes an expansion valve 13 and a first temperature sensor 12. The expansion valve 13 is arranged between the evaporator assembly 14 and the liquid pump cooling assembly 9; along a flow direction of the refrigerant in the cooling circuit 100, the first temperature sensor 12 is located at a position upstream of the expansion valve 13, to detect the temperature of the refrigerant entering the evaporator assembly 14.

With the above-mentioned arrangement, a function of performing real-time monitoring on the temperature of the refrigerant entering into the evaporator assembly 14 is achieved; in addition, arranging the expansion valve 13 may control the flow of the refrigerant entering into the evaporator assembly 14, and at the same time causes a throttling and a pressure-reducing effect, so that the evaporator assembly 14 is protected from being damaged by the effect of the high-pressure, low-temperature, or superheated refrigerant.

In the above-mentioned technical solution, the first temperature sensor 12 is configured to detect the temperature of the refrigerant entering into the evaporator assembly 14 and to control the rotation speed of the condensing fan 7 according to the detected temperature; since the temperature of the refrigerant entering into the evaporator assembly 14 is below zero, frost will form on the evaporator assembly 14, which will not only results in reduced refrigeration capacity but can have a negative impact on the refrigeration effect. In addition it can cause damage to an indoor fan if ice pieces drop down, therefore when the temperature detected by the first temperature sensor 12 is below zero, the rotation speed of the condensing fan 7 needs to be reduced, which reduces heat dissipation of the refrigerant in the condenser assembly 6, so that the refrigerant whose temperature is below zero is prevented from entering into the evaporator assembly 14, thereby ensuring a normal operation of the refrigeration system.

As shown in FIG. 1, in the present disclosure, the refrigeration system further includes a second temperature sensor 5 and a third temperature sensor 16. Both the second temperature sensor 5 and the third temperature sensor 16 are connected to the control assembly 22. The control assembly 22 controls the opening and closing of the compressor 1 and the liquid pump 95 according to signals conveyed by the second temperature sensor 5 and the third temperature sensor 16. The second temperature sensor 5 is located at a peripheral side of the condenser assembly 6 for monitoring outdoor temperature; the third temperature sensor 16 is located at a peripheral side of the evaporator assembly 14 for monitoring indoor temperature.

With the above-mentioned arrangement, according to the above-mentioned measured data, the control assembly 22 can control the refrigeration system in the different operation modes; and at the same time, such an arrangement may further monitor the environment of the refrigeration system in real time, so as to ensure the normal operation of the refrigeration system. Of course, according to practical situations, a temperature and humidity sensor may be used instead of the third temperature sensor 16.

As shown in FIG. 1, in the present disclosure, the refrigeration system further includes a first pressure sensor 8 and a second pressure sensor 11.

In the above-mentioned technical solution, the first pressure sensor 8 which is located between the condenser assembly 6 and the refrigerant inlet 93 of the liquid pump cooling assembly 9 is configured to detect a pressure value of the refrigerant in the refrigerant inlet 93; the second pressure sensor 11 is arranged on the cooling circuit 100 and located between the expansion valve 13 and a connecting node C of the cooling circuit 100 and the first pipeline 200, and is configured to detect the pressure value of the refrigerant of the first outlet 91 or the second outlet 92.

Monitoring a magnitude relationship between the pressure value of the second outlet 92 and the pressure value of the refrigerant inlet 93 may ensure the normal operation of the refrigeration system to achieve the best refrigeration effect.

The flow paths of the refrigerant in the two modes of the refrigeration system will be described below in combination with FIG. 1.

When the outdoor temperature is high, the refrigeration system when it is in the direct expansion refrigeration mode, the compressor 1 is started, and the liquid pump cooling assembly 9 is not started. At this moment, the solenoid valve 2 of an air suction port of the compressor 1 is open, the compressor 1 sucks a low-pressure refrigerant gas and discharges a superheated high-pressure gaseous refrigerant; the gaseous refrigerant discharged from the compressor 1 dissipates heat in the condenser assembly 6 through the third one-way valve 4 and is condensed into a high-pressure saturated liquid coolant in the condenser assembly 6; the liquid coolant flows into the refrigerant inlet 93 of the liquid pump cooling assembly 9 through the second branch pipe 21 of the condenser assembly 6, since the refrigerant inlet 93 and the first outlet 91 in the liquid pump cooling assembly 9 are directly connected from inside, the coolant can directly flows out from the first outlet 91 of the liquid pump cooling assembly 9; the coolant that flows out is changed to a low-temperature and low-pressure gas/liquid mixed refrigerant after passing through the first one-way valve 10 and being throttled by the expansion valve 13; then the refrigerant is evaporated by absorbing heat through the evaporator assembly 14, and takes heat from indoor environment; the coolant is changed to a low-temperature and low-pressure gaseous refrigerant after being evaporated by absorbing heat and returns to the compressor 1 through the solenoid valve 2; in this way, the circulation of the direct expansion refrigeration mode is completed, and is repeatedly performed.

When the outdoor temperature is low, and the natural cooling demand is met, the refrigeration system is in the refrigerant pumping energy-efficiency mode, the compressor 1 stops operating, and the solenoid valve 2 of the air suction port of the compressor 1 is closed, the liquid pump cooling assembly 9 is activated to operate. The low-temperature and low-pressure liquid refrigerant flowing out from the condenser assembly 6 enters into the refrigerant inlet 93 of the liquid pump cooling assembly 9, the impeller 99 of the liquid pump 95 rotates and sucks the saturated liquid refrigerant from the inner inlet 96, which is compressed and reaches, through the inner outlet 97 and the interior outlet pipe, the second outlet 92 to flow out, the coolant that flows out is compressed by the liquid pump cooling assembly 9 and thus is changed from a saturated low-temperature liquid to a sub-cooled liquid. Since a portion of coolant passes through the electric motor over the impeller 99 of the liquid pump 95, offsetting the heat generated by the electric motor, the normal operation of the electric motor is ensured. After the high-pressure coolant flows out from the second outlet 92 of the liquid pump cooling assembly 9, since the pressure value of the second outlet 92 is higher than the pressure value of the refrigerant inlet 93, the refrigerant will close the valve when it passes through the first one-way valve 10, so as to prevent the coolant from flowing back; the coolant that flows out from the liquid pump cooling assembly 9 flows into the evaporator assembly 14 through the first temperature sensor 12 and the expansion valve 13, and is evaporated by absorbing heat in the evaporator assembly 14 to be changed into the low-temperature and low-pressure gaseous coolant; since the solenoid valve 2 of the air suction port of the compressor 1 is closed, the gaseous coolant can bypass the compressor 1 and return to the condenser assembly 6 through the second one-way valve 3, and then flow into the refrigerant inlet 93 of the liquid pump cooling assembly 9 from the condenser assembly 6, so that the circulation of the refrigerant pumping energy-efficiency mode is completed, and is repeatedly performed. In a case where the refrigerant does not pass through the compressor 1, the refrigerant is condensed in the condenser assembly 6 and is evaporated in the evaporator assembly 14, which can make full use of outdoor natural cold sources to cool down the indoor equipment while the refrigerating energy consumption in low-temperature environment is greatly reduced.

Figure 4:
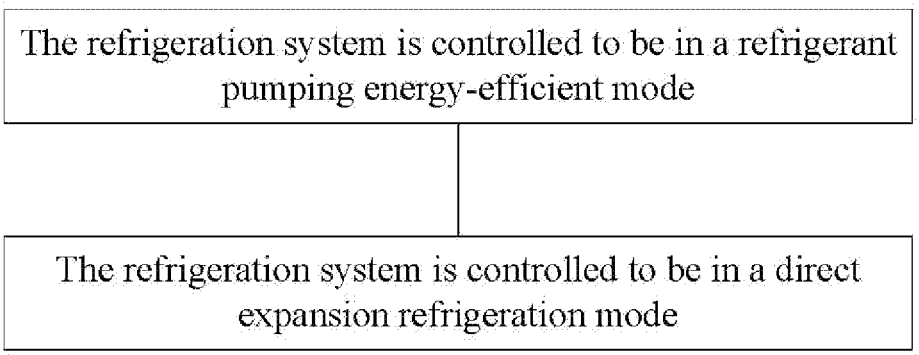
FIG. 4 shows a flowchart of a control method of a refrigeration system according to the example of the present disclosure.
Figure 5:
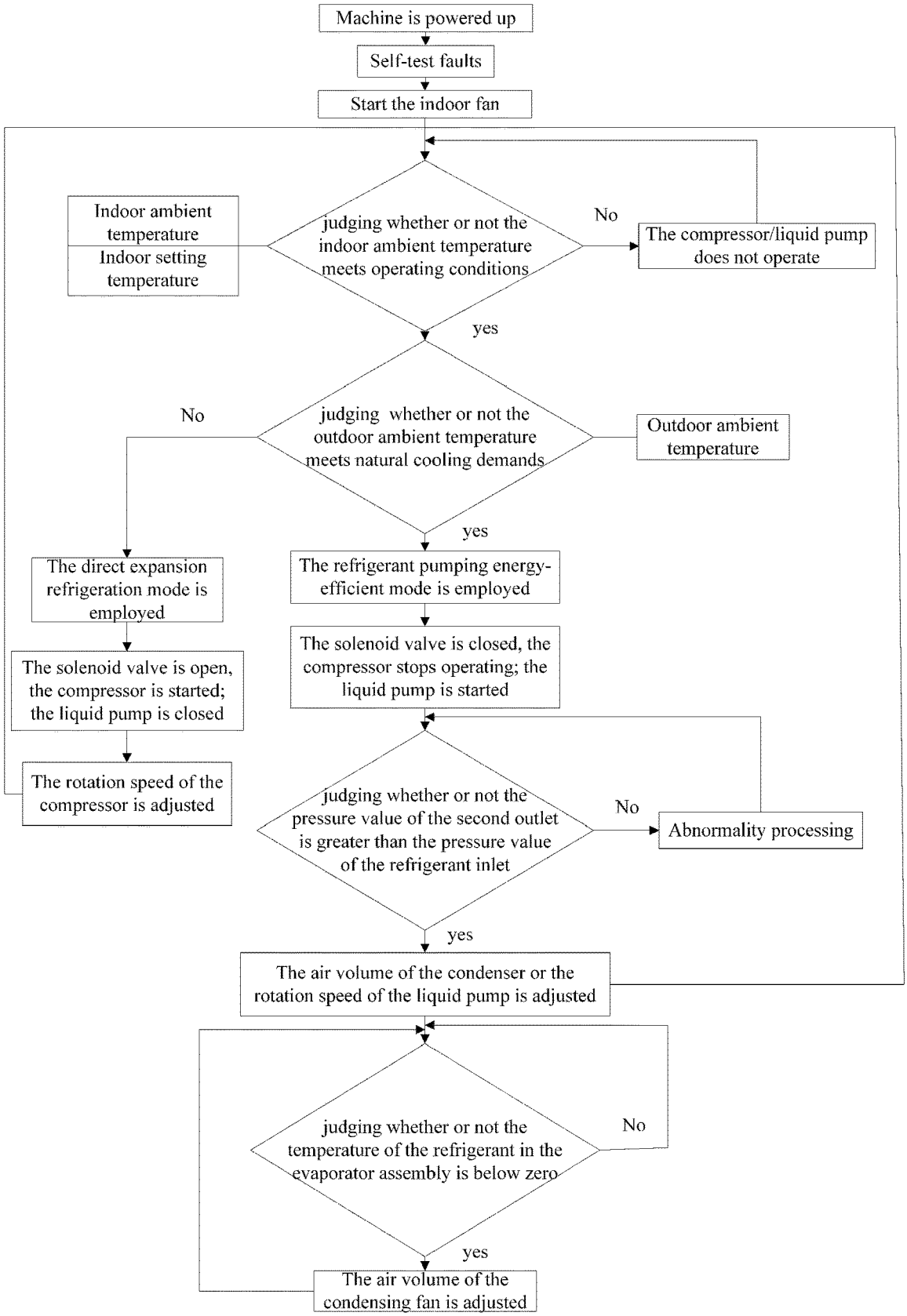
FIG. 5 shows a detailed flowchart of a control method of a refrigeration system according to the example of the present disclosure.

As shown in FIG. 4 and FIG. 5, some examples of this disclosure provide further information on how it controls the refrigeration system, which controls the above-mentioned refrigeration system through the control assembly 22.

In the present disclosure, the control method includes the following steps.

An energy-efficiency refrigeration step that controls the refrigeration system while in a refrigerant pumping energy-efficiency mode of operation.

A compression refrigeration step that controls the refrigeration system in a direct expansion refrigeration mode is provided.

With the above-mentioned arrangement, the function of switching between the two refrigeration modes based on actual demand is achieved to control the refrigeration system to be at the different refrigeration steps. For example, the outdoor temperature is high in summer, the control of temperature in a machine room cannot be achieved by only relying on indoor and outdoor heat exchange, so the compressor 1 and the solenoid valve 2 need to be activated, and at this moment the refrigeration system may be controlled in a direct expansion refrigeration mode; when the outdoor temperature is low and can meet the natural cooling demand, the compressor 1 and the solenoid valve 2 are closed to save energy, the liquid pump 95 is opened and employed to achieve natural heat exchange of the refrigerant to control the refrigeration system to be in a refrigerant pumping energy-efficiency mode.

As shown in FIG. 3 and FIG. 5, in the present disclosure, the condenser assembly 6 includes the condenser body 17 and the condensing fan 7 located at a side of the condenser body 17. After the energy-efficiency refrigeration step, the control method further includes the following steps.

Determining the pressure value of the second outlet 92 and the pressure value of the refrigerant inlet 93; A judgment step judges whether or not the pressure value of the second outlet 92 of the liquid pump cooling assembly 9 is greater than the pressure value of the refrigerant inlet 93; if so, the step of adjusting the rotation speed of the condensing fan 7 or of the liquid pump 95 is executed; if not, an abnormality processing step is executed.

With the above-mentioned arrangement, monitoring a magnitude relationship between the pressure value of the second outlet 92 and the pressure value of the refrigerant inlet 93 and executing corresponding processing steps may ensure the normal operation of the refrigeration system to achieve the best refrigeration effect.

Specifically, when the pressure value of the second outlet 92 of the liquid pump cooling assembly 9 is greater than the pressure value of the refrigeration inlet 93, it indicates that the liquid pump 95 operates normally, and at this moment, it is only necessary to adjust the rotation speed of the condensing fan 7 or of the liquid pump 95 according to the refrigeration demand; when the pressure value of the second outlet 92 of the liquid pump cooling assembly 9 minus the pressure value of the refrigerant inlet 93 is less than a deviation value, and at this moment, it indicates that abnormality occurs in the liquid pump 95, it is necessary to execute the abnormality processing step (such as, re-start the liquid pump 95, etc.), this may ensure the normal operation of the refrigeration system.

In the present disclosure, after the energy-efficiency refrigeration step, the control method further includes: a detection step of detecting the temperature of the refrigerant that enters into the evaporator assembly 14; a temperature judgment step of judging whether or not the temperature of the refrigerant is below zero, if so, the step of adjusting the rotation speed of the condensing fan 7 of the condenser assembly 6 is executed; if not, the temperature judgment step is repeated.

With the above-mentioned arrangement, the refrigerant whose temperature is below zero is prevented from entering the evaporator assembly 14, so as to avoid reducing in refrigeration capacity caused by evaporator 14 frosting and the fan damage that may be caused by the dropping of ice pieces, so that the normal operation of the refrigeration system is guaranteed while at the same time the refrigeration system having a stable refrigeration effect is ensured.

In the present disclosure, in the compression refrigeration step, the control method further includes the adjustment step of adjusting the rotation speed of the compressor 1.

With the above-mentioned arrangement, adjusting the rotation speed of the compressor 1 can control the flow rate of the refrigerant in the cooling circuit 100 and at the same time can further adjust the temperature and pressure of the refrigerant flowing out of the compressor 1, so that the normal operation of the refrigeration system is guaranteed to reach a better refrigeration effect.

From the above description, it may be seen that the above-mentioned embodiments of the present disclosure achieves the following technical effects.

The evaporator assembly is configured to evaporate the liquid refrigerant that flows in into the gaseous refrigerant, and the low-temperature and low-pressure refrigerant gas flows out; the condenser assembly may function to dissipate heat and to condense the gaseous refrigerant into the liquid refrigerant; the compressor is configured to condense the low-pressure refrigerant gas that flows in into the superheated high-pressure refrigerant gas, and the compressor can drive the refrigerant to circulate in the cooling circuit. The first pipeline and the second pipeline can send refrigerant when the refrigeration system is in the refrigerant pumping energy-efficiency mode. The first, second, and third one-way valves are able to control the flow direction of the refrigerant, thereby preventing the refrigerant in the pipeline from flowing back; the solenoid valve may control the opening and closing of the air suction port of the compressor 1, so as to ensure that the flow direction of the refrigerant in the refrigeration system is normal; the expansion valve can control the flow of the refrigerant entering into the evaporator assembly, and the first temperature sensor may monitor and feed back the temperature of the refrigerant entering into the evaporator assembly, which may protect normal operation of the evaporator assembly; the second temperature sensor and the third temperature sensor may monitor the indoor and outdoor temperature and humidity of the environment where the refrigeration system is located, so that the control assembly controls the refrigeration system to be in different refrigeration modes. The cavity having the liquid reserving function and the liquid pump are used as one modular structure, consequently there is no need to additionally arrange a separate reservoir. After this arrangement, the liquid pump cooling assembly is small in volume and compact in structure, and the arrangement may further reduce the refrigerant charge in the refrigeration system, so as to achieve functions of reducing energy consumption and costs; and at the same time, since the above-mentioned liquid pump cooling assembly is provided therein with one inlet and two outlets (i.e. the first outlet and the second outlet), the two outlets is able to send the refrigerant to different pipelines, and the refrigeration system can have the direct expansion refrigeration mode and the refrigerant pumping energy-efficiency mode, so as to achieve a function of integrating two refrigeration modes on the same cooling circuit; in addition, switching between the above-mentioned two refrigeration modes is achieved based on demand by the control assembly that connects to the compressor and the liquid pump.

The above description is only some embodiments of the present disclosure, and is not intended to limit the present disclosure, and for those skilled in the art, the present disclosure may have various modifications and changes. Any modification, equivalent replacement, improvement, etc. made according to the spirit and principle of the present disclosure shall be regarded as within the protection scope of the disclosure.

What is claimed is:

1. A refrigeration system with a direct expansion refrigeration mode and a refrigerant pumping energy-efficiency mode comprising a cooling circuit including a compressor, an evaporator assembly, and a condenser assembly sequentially arranged on the cooling circuit, the refrigeration system further comprising:

a liquid pump cooling assembly arranged on the cooling circuit and located between the condenser assembly and the evaporator assembly, wherein the liquid pump cooling assembly comprises:

a housing and a liquid pump arranged in the housing, the housing defining a cavity that has a liquid reserving function;

a refrigerant inlet communicating with the cavity;

a first outlet connected to the cavity; and a second outlet connected to the liquid pump;

wherein an outlet of the condenser assembly is connected with the refrigerant inlet, and both the first outlet and second outlet are connected with an inlet of the evaporator assembly; and a control assembly, wherein the compressor and the liquid pump are respectively connected with the control assembly to enable the refrigeration system to have a direct expansion refrigeration mode and a refrigerant pumping energy-efficiency mode;

wherein in the direct expansion refrigeration mode the compressor is in an open state and compresses refrigerant that is in a vapor phase and the liquid pump is in a closed state, such that refrigerant flowing out from the outlet of the condenser assembly enters into the evaporator assembly after sequentially passing through the refrigerant inlet and the first outlet so as to enable refrigerant to circulate in the cooling circuit by the compressor; and in the refrigerant pumping energy-efficiency mode the liquid pump is in an open state and pumps refrigerant in a liquid state and the compressor is in a closed state, such that under an effect of the liquid pump, refrigerant flowing out from the outlet of the condenser assembly flows out from the second outlet and enters the evaporator assembly.

2. The refrigeration system with the direct expansion refrigeration mode and the refrigerant pumping energy-efficiency mode of claim 1, further comprising:

a first pipeline, wherein an end of the first pipeline is connected with the second outlet and an other end of the first pipeline is connected with the inlet of the evaporator assembly; and a first one-way valve positioned on the cooling circuit, and located between the refrigerant inlet and a connecting node of the first pipeline and the cooling circuit, wherein the first one-way valve is configured to prevent refrigerant from flowing back to the refrigerant inlet when the refrigeration system is in the refrigerant pumping energy-efficiency mode, such that refrigerant flowing out from the outlet of the condenser assembly flows into the evaporator assembly through the first pipeline.

3. The refrigeration system with the direct expansion refrigeration mode and the refrigerant pumping energy-efficiency mode of claim 1, wherein in a vertical direction a height dimension of the first outlet is smaller than a height dimension of the second outlet, the refrigerant inlet is located between the first outlet and the second outlet, and the liquid pump is located below the cavity such that an interior chamber of the liquid pump is in communication with the cavity.

4. The refrigeration system with the direct expansion refrigeration mode and the refrigerant pumping energy-efficiency mode of claim 1, further comprising:

a second pipeline, arranged in parallel with the compressor, wherein a first end of the second pipeline is connected to an outlet of the evaporator assembly, and a second end of the second pipeline is connected with an inlet of the condenser assembly; and a second one-way valve arranged on the second pipeline.

5. The refrigeration system with the direct expansion refrigeration mode and the refrigerant pumping energy-efficiency mode of claim 4, further comprising a solenoid valve arranged on the cooling circuit, wherein the solenoid valve is located between an inlet of the compressor and a connecting node of the second pipeline and the cooling circuit.

6. The refrigeration system with the direct expansion refrigeration mode and the refrigerant pumping energy-efficiency mode of claim 1, wherein the condenser assembly comprises:

a condenser body having a condensing inlet and a condensing outlet;

a gas header communicating with the condensing inlet, wherein the gas header is connected to an outlet of the compressor; and a liquid header communicating with the condensing outlet and connected with the refrigerant inlet, wherein a pipe diameter of the liquid header is greater than a pipe diameter of the gas header.

7. The refrigeration system with the direct expansion refrigeration mode and the refrigerant pumping energy-efficiency mode of claim 6, wherein the condenser body is V-shaped, and the condenser assembly further comprises:

a condensing fan arranged over the condenser body;

a first branch pipe; and a second branch pipe;

wherein the gas header is connected with the outlet of the compressor through the first branch pipe, and the liquid header is connected with the refrigerant inlet through the second branch pipe.

8. The refrigeration system with the direct expansion refrigeration mode and the refrigerant pumping energy-efficiency mode of claim 1, further comprising:

an expansion valve arranged between the evaporator assembly and the liquid pump cooling assembly; and a first temperature sensor located at an upstream position of the expansion valve along a flow direction of refrigerant in the cooling circuit to detect a temperature of refrigerant entering into the evaporator assembly.

9. A control method of the refrigeration system of claim 1, the control method comprising:

an energy-efficiency refrigeration step of controlling the refrigeration system to be in a refrigerant pumping energy-efficiency mode; and a compression refrigeration step of controlling the refrigeration system to be in a direct expansion refrigeration mode.

10. The control method of claim 9, wherein the condenser assembly comprises a condenser body and a condensing fan located at a side of the condenser body, and after the energy-efficiency refrigeration step the control method further comprises:

a determining step of determining a pressure value of the second outlet and a pressure value of the refrigeration inlet; and a pressure value judgment step of judging whether or not the pressure value of the second outlet of the liquid pump cooling assembly is greater than the pressure value of the refrigerant inlet; wherein— when it is judged that the pressure value of the second outlet is greater than the pressure value of the refrigerant inlet, a step of adjusting a rotation speed of the condensing fan or the liquid pump is executed; and when it is judged that the pressure value of the second outlet is not greater than the pressure value of the refrigerant inlet, an abnormality processing step is executed.

11. The control method of claim 9, wherein after the energy-efficiency refrigeration step, the control method further comprises:

a detection step of detecting a temperature of refrigerant that enters into the evaporator assembly; and a temperature judgment step of judging whether or not the temperature of refrigerant is below zero; wherein when it is judged that the temperature of refrigerant is below zero, a step of adjusting a rotation speed of the condensing fan of the condenser assembly is executed; and when it is judged that the temperature of refrigerant is not below zero, the temperature judgment step is repeatedly executed.

12. The control method of claim 9, wherein the compression refrigeration step further comprises an adjustment step of adjusting a rotation speed of the compressor.

13. The control method of claim 9, wherein the refrigeration system further comprises:

a first pipeline, wherein an end of the firstpipe line is connected with the second outlet and an other end of the first pipeline is connected with the inlet of the evaporator assembly; and a first one-way valve positioned on the cooling circuit and located between the refrigerant inlet and a connecting node of the first pipeline and the cooling circuit, wherein the first one-way valve is configured to prevent refrigerant from flowing back to the refrigerant inlet when the refrigeration system is in the refrigerant pumping energy-efficiency mode, such that refrigerant flowing out from the outlet of the condenser assembly flows into the evaporator assembly through the first pipeline.

14. The control method of claim 9, wherein in a vertical direction a height dimension of the first outlet is smaller than a height dimension of the second outlet, the refrigerant inlet is located between the first outlet and the second outlet, and the liquid pump is located below the cavity such that an interior chamber of the liquid pump is in communication with the cavity.

15. The control method of claim 9, wherein the refrigeration system further comprises:

a second pipeline, arranged in parallel with the compressor, wherein a first end of the second pipeline is connected to an outlet of the evaporator assembly, and a second end of the second pipeline is connected with an inlet of the condenser assembly; and a second one-way valve arranged on the second pipeline.

16. The control method of claim 15, wherein the refrigeration system further comprises a solenoid valve arranged on the cooling circuit, wherein the solenoid valve is located between an inlet of the compressor and a connecting node of the second pipeline and the cooling circuit.

17. The control method of claim 9, wherein the condenser assembly comprises:

a condenser body having a condensing inlet and a condensing outlet;

a gas header communicating with the condensing inlet, wherein the gas header is connected to an outlet of the compressor; and a liquid header communicating with the condensing outlet and connected with the refrigerant inlet, wherein a pipe diameter of the liquid header is greater than a pipe diameter of the gas header.

18. The control method of claim 17, wherein the condenser body is V-shaped, and the condenser assembly further comprises:

a condensing fan arranged over the condenser body;

a first branch pipe; and a second branch pipe, wherein the gas header is connected with the outlet of the compressor through the first branch pipe, and the liquid header is connected with the refrigerant inlet through the second branch pipe.

19. The control method of claim 9, wherein the refrigeration system further comprises:

an expansion valve arranged between the evaporator assembly and the liquid pump cooling assembly; and a first temperature sensor located at an upstream position of the expansion valve along a flow direction of refrigerant in the cooling circuit to detect a temperature of refrigerant entering the evaporator assembly.

* * * * *